US009428716B2

(12) United States Patent
Kropf et al.

(10) Patent No.: US 9,428,716 B2
(45) Date of Patent: Aug. 30, 2016

(54) WASHING AND CLEANING COMPOSITIONS WITH IMPROVED PERFORMANCE

(71) Applicant: Henkel AG & Co. KGaA, Duesseldorf (DE)

(72) Inventors: Christian Kropf, Hilden (DE); Mareile Job, Leverkusen (DE); Christian Umbreit, Neuss (DE); Siglinde Erpenbach, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/307,930

(22) Filed: Jun. 18, 2014

(65) Prior Publication Data

US 2014/0303395 A1 Oct. 9, 2014

Related U.S. Application Data

(63) Continuation of application No. PCT/EP2012/074887, filed on Dec. 10, 2012.

(30) Foreign Application Priority Data

Dec. 19, 2011 (DE) ..... 10 2011 088 984

(51) Int. Cl.

| | |
|---|---|
| ***C11D 11/00*** | (2006.01) |
| ***C11D 3/00*** | (2006.01) |
| ***C11D 3/20*** | (2006.01) |
| ***C11D 3/32*** | (2006.01) |
| ***C11D 3/395*** | (2006.01) |

(52) U.S. Cl.
CPC ..... *C11D 3/3955* (2013.01); *C11D 3/0084* (2013.01); *C11D 3/2093* (2013.01); *C11D 3/32* (2013.01); *C11D 11/0017* (2013.01)

(58) Field of Classification Search
CPC ..... C11D 11/0017; C11D 3/0084; C11D 3/2093; C11D 3/32; C11D 3/3955
See application file for complete search history.

(56) References Cited

U.S. PATENT DOCUMENTS

| | | | | |
|---|---|---|---|---|
| 2003/0105031 | A1* | 6/2003 | Rosenbloom | 514/27 |
| 2012/0157370 | A1 | 6/2012 | Kropf et al. | |

FOREIGN PATENT DOCUMENTS

| | | | |
|---|---|---|---|
| JP | 2002293704 | * | 9/2002 |
| JP | 2005-213194 | A | 8/2005 |
| WO | WO2008101909 | * | 8/2008 |
| WO | 2008/131047 | A2 | 10/2008 |

OTHER PUBLICATIONS

Translation of JP2002293704, Sep. 10, 2002, p. 1-16.*
Translation of WO2008101909, Aug. 28, 2008, p. 1-49.*
PCT International Search Report (PCT/EP2012/074887) dated Feb. 19, 2013.

* cited by examiner

*Primary Examiner* — Paul A Zucker
*Assistant Examiner* — Mark Luderer
(74) *Attorney, Agent, or Firm* — Thomas G. Krivulka

(57) ABSTRACT

The present invention relates to the use of oligohydroxybenzoic acid derivatives in washing and cleaning agents in order to improve washing or cleaning performance with respect to bleachable stains.

4 Claims, No Drawings

WASHING AND CLEANING COMPOSITIONS WITH IMPROVED PERFORMANCE

FIELD OF THE INVENTION

The present invention generally relates to the use of oligohydroxybenzoic acid derivatives in washing and cleaning agents in order to improve washing or cleaning performance.

BACKGROUND OF THE INVENTION

While the formulation of powdered washing and cleaning agents containing bleaching agent nowadays no longer presents difficulties, the formulation of stable liquid washing and cleaning agents containing bleaching agent still represents a problem. Because bleaching agent is usually absent from liquid washing and cleaning agents, those stains which normally are removed in particular because of the bleaching agent that is contained are accordingly often removed only to an insufficient extent. A similar problem also exists for bleaching-agent-free color washing agents, in which the bleaching agent is omitted in order to reduce stress on the dyes in the textile and to prevent them from bleaching out. A complicating factor when bleaching agent is absent is that instead of removing the so-called "bleachable" stains that normally are removed at least in part by the peroxygen-based bleaching agent, the washing operation often in fact results, to the contrary, in an intensification of the stain and/or in a deterioration in its ability to be removed; this is probably attributable not least to initiated chemical reactions that can consist, for example, in the polymerization of specific dyes contained in the stains.

Such problems occur in particular with stains that contain polymerizable substances. The polymerizable substances are principally polyphenolic dyes, preferably flavonoids, in particular from the class of anthocyanidins or anthocyans. The stains can have been caused in particular by food products or beverages that contain corresponding dyes. The stains can in particular be spots caused by fruits or vegetables, or also red-wine spots, which contain in particular polyphenolic dyes, principally those from the class of the anthocyanidins or anthocyans.

International patent application WO 2011/023716 A1 discloses the use of gallic acid esters, such as propyl gallate, in washing and cleaning agents for improved removal of stains that contain polymerizable substances.

Gallic acid esters of polyvalent alcohols, and the use thereof as inhibitors for plasminogen activator 1 (PAI-1), are known from International patent application WO 2008/131047.

It has been found, surprisingly, that as a result of the use of specific oligohydroxybenzoic acid derivatives that comprise more than one oligohydroxybenzoic acid unit, the washing or cleaning performance of the washing or cleaning agent can be appreciably improved in particular in terms of bleachable stains.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Use of compounds of the general formula (I), (I)

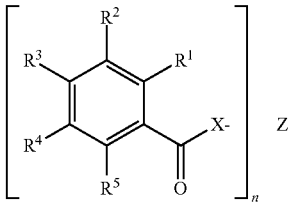

in which $R^1$, $R^2$, $R^3$, $R^4$, and $R^5$ mutually independently denote hydrogen or OH with the provision that at least two of said residues are OH, X denotes oxygen or NR, n is a number from 2 to 20, and Z denotes a cyclic or acyclic, straight-chain or branched-chain, n-bonded hydrocarbon residue having 2 to 100 carbon atoms, whose skeleton can be penetrated by one or more non-adjacent oxygen or nitrogen atoms and/or can be mono- or polysubstituted with hydrophilic groups such as NRR', COOR, CONRR', and/or OR, R and R' mutually independently denote hydrogen or a cyclic or acyclic, straight-chain or branched-chain, aliphatic or aromatic hydrocarbon residue having 1 to 20 carbon atoms, in washing or cleaning agents in order to improve washing or cleaning performance with respect to bleachable stains.

A washing or cleaning agent containing 0.001 wt % to 5 wt % of a compound of the general formula (I), (I)

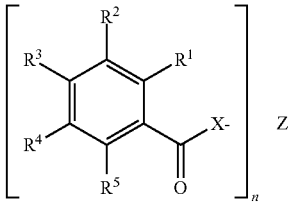

in which $R^1$, $R^2$, $R^3$, $R^4$, and $R^5$ mutually independently denote hydrogen or OH with the provision that at least two of said residues are OH, X denotes oxygen or NR, n is a number from 2 to 20, and Z denotes a cyclic or acyclic, straight-chain or branched-chain, n-bonded hydrocarbon residue having 2 to 100 carbon atoms, whose skeleton can be penetrated by one or more non-adjacent oxygen or nitrogen atoms, and/or can be mono- or polysubstituted with hydrophilic groups such as NRR', COOR, CONRR', and/or OR, R and R' mutually independently denote hydrogen or a cyclic or acyclic, straight-chain or branched-chain, aliphatic or aromatic hydrocarbon residue having 1 to 20 carbon atoms.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A first subject of the present invention is therefore the use of compounds of the general formula (I), (I)

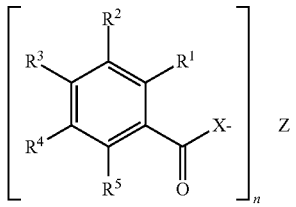

in which $R^1$, $R^2$, $R^3$, $R^4$, and $R^5$ mutually independently denote hydrogen or OH with the provision that at least two of said residues are OH, X denotes oxygen or NR, n is a number from 2 to 20, preferably from 2 to 6, and Z denotes a cyclic or acyclic, straight-chain or branched-chain, n-bonded hydrocarbon residue having 2 to 100, preferably 2 to 20 carbon atoms, whose skeleton can be penetrated by one or more non-adjacent oxygen or nitrogen atoms and/or can be mono- or polysubstituted with hydrophilic groups such as NRR', COOR, CONRR', and/or OR, R and R' mutually independently denote hydrogen or a cyclic or acyclic, straight-chain or branched-chain, aliphatic or aromatic hydrocarbon residue having 1 to 20 carbon atoms, in washing or cleaning agents in order to improve washing or cleaning performance with respect to bleachable stains.

The bleachable stains usually contain polymerizable substances, in particular polymerizable dyes; the polymerizable dyes are preferably polyphenolic dyes, in particular flavonoids, principally anthocyanidins or anthocyans or oligomers of said compounds. Besides the removal of stains in the colors green, yellow, red, or blue, that of stains of intermediate colors, in particular violet, mauve, brown, purple, or pink, is also relevant, also of stains that have a green, yellow, red, violet, mauve, brown, purple, pink, or blue hue, without being themselves entirely made up of that color. The aforesaid colors can, in particular, also be respectively light or dark. These are preferably stains, in particular spots, of grass, fruits, or vegetables, in particular also stains resulting from food products such as spices, sauces, chutneys, curries, purees, and jams, or beverages such as coffee, tea, wines, and juices, that contain corresponding green, yellow, red, violet, mauve, brown, purple, pink, and/or blue dyes.

The stains to be removed according to the present invention can in particular be caused by cherry, morel cherry, grape, apple, pomegranate, chokeberry, plum, sea buckthorn, açai, kiwi, mango, grass, or berries, in particular by red or black currants, elderberries, blackberries, raspberries, blueberries, lingonberries, cranberries, strawberries, or bilberries, by coffee, tea, red cabbage, blood orange, eggplant, tomato, carrot, red beets, spinach, paprika, red or blue potatoes, or red onions.

In the compounds of the general formula (I) preferably at least two, in particular at least three of the residues $R^1$, $R^2$, $R^3$, $R^4$, and $R^5$ denote OH; this refers in particular to a derivative of 2,3-dihydroxybenzoic acid, 2,4-dihydroxybenzoic acid, 2,5-dihydroxybenzoic acid, 2,6-dihydroxybenzoic acid, 2,3,4-trihydroxybenzoic acid, 2,4,5-trihydroxybenzoic acid, or 2,4,6-trihydroxybenzoic acid, and particularly preferably to a derivative of gallic acid ($R^1$=H, $R^2$=OH, $R^3$=OH, $R^4$=OH, $R^5$=H). The oligohydroxybenzoic acid derivative of the general formula (I) is an ester or an amide of an alcohol, amine, or aminoalcohol $(HX)_nZ$ carrying at least two hydroxy groups or at least two amino groups or at least one hydroxy group and at least one amino group. Preferably the alcohol is a polyalkylene glycol and the amine is a polyalkyleneimine; their oxygen or nitrogen atoms are preferably separated from one another by alkylene groups having two to 12 carbon atoms, in particular two to 6 carbon atoms; not all the alkylene groups need to have the same number of carbon atoms. Ethylene groups, 1,2-propylene groups, 1,3-propylene groups, and mixtures thereof are particularly preferred. The same is analogously true for the aminoalcohols. The polyalkylene glycol has alcohol functions at the ends, and the polyamine has primary amino functions at the ends and preferably both secondary and tertiary amino functions in the interior. The compound $(HX)_nZ$ preferably has an average molar mass in the range from 60 g/mol to 4000 g/mol, in particular from 60 g/mol to 1000 g/mol. The average molar masses that may be indicated here and hereinafter for other oligomers or polymers are weight-average molar masses $M_w$ that can be determined in principle by gel permeation chromatography with the aid of an RI detector, the measurement usefully being performed against an external standard.

Compounds according to formula (I) are preferably selected from the group comprising the following representatives and mixtures of at least two of said compounds:

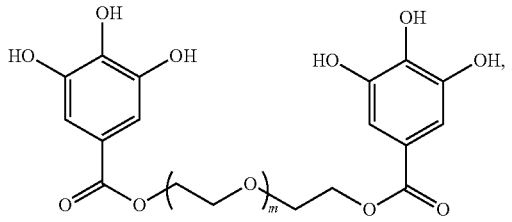

where $m$ = 0 to 11 ethylene glycol digallate,
diethylene glycol digallate,
triethylene glycol digallate,
tetraethylene glycol digallate,
pentaethylene glycol digallate,
hexaethylene glycol digallate,
heptaethylene glycol digallate,
octaethylene glycol digallate,
nonaethylene glycol digallate,
decaethylene glycol digallate,
undecaethylene glycol digallate,
dodecaethylene glycol digallate,

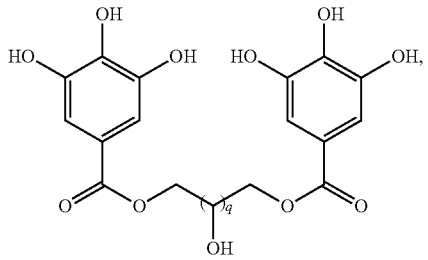

where $q$ = 1 to 4 glyceryl digallate,
erythritol digallate, threitol digallate,
xylitol digallate,
sorbitol digallate,
mannitol digallate,
glyceryl trigallate,
pentaerythritol digallate,
pentaerythritol trigallate,
pentaerythritol tetragallate,
bis-gallic acid amide of polyoxyethylene/oxypropylenediamine (e.g. Jeffamine® of the Huntsman company),
bis-gallic acid amide of polyoxyethylene/oxypropylenetriamine (e.g. Jeffamine® of the Huntsman company),
tris-gallic acid amide of polyoxyethylene/oxypropylenetriamine (e.g. Jeffamine® of the Huntsman company),
bis-N,N'-(3,4,5-trihydroxybenzoyl)arginine,
bis-N,N'-(3,4,5-trihydroxybenzoyl)lysine,

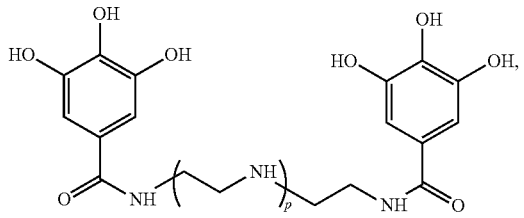

where $p = 0$ to 4 ethylenediamine bis-gallic acid amide,
diethylenetriamine bis-gallic acid amide,
triethylenetetramine bis-gallic acid amide,
tetraethylenepentamine bis-gallic acid amide,
pentaethylenehexamine bis-gallic acid amide.

The compound of the general formula (I) is preferably used according to the present invention in washing and cleaning agents by being employed in a quantity from 0.001 wt % to 5 wt %, in particular in a quantity from 0.1 wt % to 4 wt %; here and hereinafter, indications of "wt %" refer respectively to the weight of the total washing or cleaning agent. A further subject of the invention is therefore a washing or cleaning agent containing 0.001 wt % to 5 wt %, in particular 0.1 wt % to 4 wt %, of a compound of the general formula (I), where the preferred embodiments described previously and hereinafter also apply to this subject of the invention.

The washing or cleaning agents can be present in any administration form established in the existing art and/or in any useful administration form. These include, for example, solid, powdered, liquid, gelled, or pasty administration forms, optionally also made up of multiple phases; also included thereamong are extrudates, granulates, tablets, or pouches, packaged both in large containers and in portions.

In a preferred embodiment, the use according to the present invention takes place in a washing and cleaning agent that contains no bleaching agents. This is to be understood to mean that the agent contains no bleaching agents in the narrower sense, i.e. hypochlorites, hydrogen peroxide, or substances yielding hydrogen peroxide; preferably, it also comprises no bleach activators and/or bleach catalysts.

In a particularly preferred embodiment, the washing agent is a liquid textile washing agent.

In a further particularly preferred embodiment, the washing agent is a powdered or liquid color washing agent, i.e. a textile washing agent for colored textiles.

The washing and cleaning agents can furthermore contain other usual constituents of washing or cleaning agents, in particular textile washing agents, selected in particular from the group of builders, surfactants, polymers, enzymes, disintegration adjuvants, scents, and perfume carriers.

Included among the builders are in particular zeolites, silicates, carbonates, organic cobuilders, and—provided no environmental prejudices against their use exist—also phosphates.

The finely crystalline synthetic zeolite containing bound water that is preferably used is zeolite A and/or zeolite P. Zeolite MAP® (commercial product of the Crosfield Co.), for example, is appropriate as zeolite P. Also suitable, however, are zeolite X as well as mixtures of A, X, and/or P. Also commercially available and usable in the context of the present invention is, for example, a co-crystal of zeolite X and zeolite A (approx. 80 wt % zeolite X) that can be described by the formula $$n\mathrm{Na_2O}\cdot(1-n)\mathrm{K_2O}\cdot\mathrm{Al_2O_3}\cdot(2-2.5)\mathrm{SiO_2}\cdot(3.5-5.5)\mathrm{H_2O}.$$

The zeolite can be used both as a builder in a granular compound and as a kind of "dusting" on a granular mixture, preferably a mixture to be compressed, both approaches to incorporation of the zeolite into the pre-mixture usually being used. Zeolites can exhibit an average particle size of less than 10 μm (volume distribution; measurement method: Coulter Counter), and preferably contain 18 wt % to 22 wt %, in particular 20 wt % to 22 wt %, bound water.

Crystalline sheet silicates of the general formula $NaMSi_xO_{2x+1}\cdot y\ H_2O$ can also be used, where M represents sodium or hydrogen, x is a number from 1.9 to 22, preferably from 1.9 to 4, particularly preferred values for x being 2, 3, or 4, and y denotes a number from 0 to 33, preferably from 0 to 20. The crystalline sheet silicates of the formula $NaMSi_xO_{2x+1}\cdot y\ H_2O$ are marketed, for example, by Clariant GmbH (Germany) under the trade name Na-SKS. Examples of these silicates are Na-SKS-1 ($Na_2Si_{22}O_{45}\cdot xH_2O$, kenyaite), Na-SKS-2 ($Na_2Si_{14}O_{29}\cdot xH_2O$, magadiite), Na-SKS-3 ($Na_2Si_8O_{17}\cdot xH_2O$), or Na-SKS-4 ($Na_2Si_4O_9\cdot xH_2O$, makatite).

Crystalline sheet silicates of the formula $NaMSi_xO_{2x+1}\cdot y\ H_2O$ in which x denotes 2 are preferred. Both β- and δ-sodium disilicates $Na_2Si_2O_5\cdot y\ H_2O$, as well as also principally Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$), and Na-SKS-13 ($NaHSi_2O_5$), but in particular Na-SKS-6 ($\delta$-$Na_2Si_2O_5$), are particularly preferred. Washing or cleaning agents preferably contain a weight proportion of the crystalline sheet silicates of the formula $NaMSi_xO_{2x+1}\cdot y\ H_2O$ from 0.1 wt % to 20 wt %, preferably from 0.2 wt % to 15 wt %, and in particular from 0.4 wt % to 10 wt %.

Also usable are amorphous sodium silicates having a $Na_2O:SiO_2$ modulus from 1:2 to 1:3.3, preferably from 1:2 to 1:2.8, and in particular from 1:2 to 1:2.6, which are preferably dissolution-delayed and exhibit secondary washing properties. The dissolution delay as compared with conventional amorphous sodium silicates can have been brought about in various ways, for example by surface treatment, compounding, compacting/densification, or overdrying. The term "amorphous" is understood to mean that in X-ray diffraction experiments the silicates do not yield the sharp X-ray reflections that are typical of crystalline substances, but produce at most one or more maxima in the scattered X radiation that have a width of several degree units of the diffraction angle.

Alternatively or in combination with the aforesaid amorphous sodium silicates, it is possible to use X-amorphous silicates whose silicate particles yield blurred or even sharp diffraction maxima in electron beam diffraction experiments. This is to be interpreted to mean that the products comprise microcrystalline regions 10 to several hundred nm in size, values of up to a maximum of 50 nm, and in particular up to a maximum of 20 nm, being preferred. X-amorphous silicates of this kind likewise exhibit a dissolution delay as compared with conventional water glasses. Densified/compacted amorphous silicates, compounded amorphous silicates, and overdried X-amorphous silicates are particularly preferred.

This/these silicate(s), preferably alkali silicates, particularly preferably crystalline or amorphous alkali disilicates, if present, are contained in washing and cleaning agents in quantities from 3 wt % to 60 wt %, preferably from 8 wt % to 50 wt %, and in particular from 20 wt % to 40 wt %.

Utilization of the commonly known phosphates as builder substances is also possible, provided such use is not to be avoided for environmental reasons. Among the plurality of commercially obtainable phosphates, the alkali-metal phosphates have the greatest significance in the washing- and cleaning-agent industry, with particular preference for pentasodium or pentapotassium triphosphate (sodium or potassium tripolyphosphate).

"Alkali-metal phosphates" is the summary designation for the alkali-metal (in particular sodium and potassium) salts of the various phosphoric acids, in which context a distinction can be made between metaphosphoric acids $(HPO_3)_n$ and orthophosphoric acid $H_3PO_4$, in addition to higher-molecular-weight representatives. The phosphates embody a combination of advantages: they act as alkali carriers, prevent lime deposits on machine parts or lime incrustations in fabrics, and furthermore contribute to cleaning performance. Phosphates that are technically especially important are pentasodium triphosphate $Na_5P_3O_{10}$ (sodium tripolyphosphate) and the corresponding potassium salt pentapotassium triphosphate $K_5P_3O_{10}$ (potassium tripolyphosphate). Sodium potassium tripolyphosphates are also used with preference. If phosphates are employed in washing or cleaning agents, preferred agents then contain that/those phosphate(s), preferably alkali metal phosphate(s), particularly preferably pentasodium or pentapotassium triphosphate (sodium or potassium tripolyphosphate), in quantities from 5 wt % to 80 wt %, preferably from 15 wt % to 75 wt %, and in particular from 20 wt % to 70 wt %.

Alkali carriers are also usable. Alkali carriers are considered to be, for example, alkali-metal hydroxides, alkali-metal carbonates, alkali-metal hydrogen carbonates, alkali-metal sesquicarbonates, the aforesaid alkali silicates, alkali metasilicates, and mixtures of the aforesaid substances; the alkali carbonates, in particular sodium carbonate, sodium hydrogen carbonate, or sodium sesquicarbonate, are preferably used. A builder system containing a mixture of tripolyphosphate and sodium carbonate can be particularly preferred. Because of their low chemical compatibility with the other ingredients of washing or cleaning agents as compared with other builder substances, the alkali-metal hydroxides are preferably used only in small quantities, preferably in quantities below 10 wt %, preferably below 6 wt %, particularly preferably below 4 wt %, and in particular below 2 wt %. Agents that contain, based on their total weight, less than 0.5 wt % and in particular no alkali-metal hydroxides are particularly preferred. It is preferred to use carbonate(s) and/or hydrogen carbonate(s), preferably alkali carbonate (s), particularly preferably sodium carbonate, in quantities from 2 wt % to 50 wt %, preferably from 5 wt % to 40 wt %, and in particular from 7.5 wt % to 30 wt %.

Organic builders that are to be recited are in particular polycarboxylates/polycarboxylic acids, polymeric polycarboxylates, aspartic acid, polyacetals, dextrins, as well as phosphonates. Polycarboxylic acids are usable, for example, in the form of the free acid and/or sodium salts thereof, "polycarboxylic acids" being understood as those carboxylic acids which carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), provided such use is not objectionable for environmental reasons, as well as mixtures thereof. The free acids typically also possess, besides their builder effect, the property of an acidifying component, and thus also serve to establish a lower and milder pH for washing or cleaning agents. To be recited in this context are, in particular, citric acid, succinic acid, glutaric acid, adipic acid, gluconic acid, and any mixtures thereof. Also suitable as builders are polymeric polycarboxylates; these are, for example, the alkali metal salts of polyacrylic acid or of polymethacrylic acid, for example those having a relative molecular weight from 500 to 70,000 g/mol. Polyacrylates that preferably have a molecular weight from 2000 to 20,000 g/mol are particularly suitable. Of this group in turn, the short-chain polyacrylates, which have molar masses from 2000 to 10,000 g/mol and particularly preferably from 3000 to 5000 g/mol, can be preferred because of their superior solubility. Also suitable are copolymeric polycarboxylates, in particular those of acrylic acid with methacrylic acid and of acrylic acid or methacrylic acid with maleic acid. Copolymers of acrylic acid with maleic acid that contain 50 wt % to 90 wt % acrylic acid and 50 wt % to 10 wt % maleic acid have proven particularly suitable. Their relative molecular weight, based on free acids, is generally 2000 g/mol to 70,000 g/mol, preferably 20,000 g/mol to 50,000 g/mol, and in particular 30,000 gmol to 40,000 g/mol. To improve water solubility, the polymers can also contain allylsulfonic acids, for example allyloxybenzenesulfonic acid and methallylsulfonic acid, as monomers. The (co)polymeric polycarboxylates can be employed as a solid or in aqueous solution. The concentration of (co)polymeric polycarboxylates in washing or cleaning agents is preferably 0.5 wt % to 20 wt %, and in particular 3 wt % to 10 wt %.

Also particularly preferred are biodegradable polymers made up of more than two different monomer units, for example those that contain as monomers salts of acrylic acid and of maleic acid as well as vinyl alcohol or vinyl alcohol derivatives, or that contain as monomers salts of acrylic acid and of 2-alkylallylsulfonic acid, as well as sugar derivatives. Further preferred copolymers are those that comprise acrolein and acrylic acid/acrylic acid salts, or acrolein and vinyl acetate, as monomers. Also to be mentioned as further preferred builder substances are polymeric aminodicarboxylic acids, salts thereof, or precursor substances thereof. Polyaspartic acids and/or salts thereof are particularly preferred.

A further substance class having builder properties is represented by phosphonates. These are the salts of, in particular, hydroxyalkane- or aminoalkanephosphonic acids. Among the hydroxyalkanephosphonic acids, 1-hydroxyethane-1,1-diphosphonate (HEDP) is of particular importance. It is employed in particular as a sodium salt, the disodium salt reacting neutrally and the tetrasodium salt in alkaline fashion. Suitable aminoalkanephosphonic acids are, in particular, ethylenediaminetetramethylenephosphonic acid (EDTMP), diethylenetriaminepentamethylenephosphonic acid (DTPMP), and their higher homologs. They are used in particular in the form of the neutrally reacting sodium salts, e.g. as the hexasodium salt of EDTMP or as the hepta- and octasodium salt of DTPMP. Mixtures of the aforesaid phosphonates can also be used as organic builders. Aminoalkanephosphonates in particular moreover possess a pronounced heavy-metal binding capability.

Further suitable builder substances are polyacetals, which can be obtained by reacting dialdehydes with polyolcarboxylic acids that comprise 5 to 7 carbon atoms and at least three hydroxyl groups. Preferred polyacetals are obtained from dialdehydes such as glyoxal, glutaraldehyde, terephthalaldehyde and mixtures thereof, and from polyolcarboxylic acids such as gluconic acid and/or glucoheptonic acid.

Further suitable organic builder substances are dextrins, for example oligomers or polymers of carbohydrates, which can be obtained by partial hydrolysis of starches. Hydrolysis can be carried out in accordance with usual, e.g. acid- or enzyme-catalyzed, methods. These are preferably hydrolysis products having average molar weights in the range from 400 g/mol to 500,000 g/mol. A polysaccharide having a dextrose equivalent (DE) in the range from 0.5 to 40, in particular from 2 to 30, is preferred, DE being a common indicator of the reducing effect of a polysaccharide as compared with dextrose, which possesses a DE of 100. Both maltodextrins having a DE between 3 and 20 and dry glucose syrups having a DE between 20 and 37, as well as so-called yellow dextrins and white dextrins having higher molar weights in the range from 2000 to 30,000 g/mol, are usable. The oxidized derivatives of such dextrins are their reaction products with oxidizing agents that are capable of oxidizing at least one alcohol function of the saccharide ring to the carboxylic acid function.

Oxydisuccinates and other derivatives of disuccinates, preferably ethylenediamine disuccinate, are additional suitable cobuilders. Ethylenediamine-N,N'-disuccinate (EDDS) is used here, preferably in the form of its sodium or magnesium salts. Also preferred in this context are glycerol disuccinates and glycerol trisuccinates. If desired, suitable utilization quantities in particular in zeolite-containing and/or silicate-containing formulations are 3 wt % to 15 wt %.

Other usable organic cobuilders are, for example, acetylated hydroxycarboxylic acids or salts thereof, which can optionally also be present in lactone form and which contain at least 4 carbon atoms and at least one hydroxy group, as well as a maximum of two acid groups.

All compounds that are capable of forming complexes with alkaline earth ions can also be used as builders.

Washing and cleaning agents can contain nonionic, anionic, cationic, and/or amphoteric surfactants.

All nonionic surfactants known to one skilled in the art can be used as nonionic surfactants. With particular preference, washing or cleaning agents contain nonionic surfactants from the group of the alkoxylated alcohols. The nonionic surfactants used are preferably alkoxylated, advantageously ethoxylated, in particular primary alcohols having preferably 8 to 18 carbon atoms and an average of 1 to 12 mol ethylene oxide (EO) per mol of alcohol, in which the alcohol residue can be linear or preferably methyl-branched in the 2-position, or can contain mixed linear and methyl-branched residues, such as those that are usually present in oxo alcohol residues. Particularly preferred, however, are alcohol ethoxylates having linear residues made up of alcohols of natural origin having 12 to 18 carbon atoms, e.g. from coconut, palm, tallow, or oleyl alcohol, and an average of 2 to 8 EO per mol of alcohol. The preferred ethoxylated alcohols include, for example, $C_{12-14}$ alcohols with 3 EO or 4 EO, $C_{9-11}$ alcohols with 7 EO, $C_{13-15}$ alcohols with 3 EO, 5 EO, 7 EO, or 8 EO, $C_{12-18}$ alcohols with 3 EO, 5 EO, or 7 EO, and mixtures thereof, such as mixtures of $C_{12-14}$ alcohol with 3 EO and $C_{12-18}$ alcohol with 5 EO. The degrees of ethoxylation indicated represent statistical averages that can correspond to an integral or a fractional number for a specific product. Preferred alcohol ethoxylates exhibit a restricted distribution of homologs (narrow range ethoxylates, NRE).

Alternatively or in addition to these nonionic surfactants, fatty alcohols with more than 12 EO can also be used. Examples of these are tallow fatty alcohol with 14 EO, 25 EO, 30 EO, or 40 EO. Also usable as further nonionic surfactants are alkylglycosides of the general formula $RO(G)_x$ in which R corresponds to a primary straight-chain or methyl-branched aliphatic residue, in particular methyl-branched in the 2-position, having 8 to 22, preferably 12 to 18 carbon atoms, and G is the symbol that denotes a glycose unit having 5 or 6 carbon atoms, preferably glucose. The degree of oligomerization x, which indicates the distribution of monoglycosides and oligoglycosides, is any number between 1 and 10; x is preferably 1.2 to 1.4.

A further class of nonionic surfactants used in preferred fashion, which are used either as the only nonionic surfactant or in combination with other nonionic surfactants, are alkoxylated, preferably ethoxylated or ethoxylated and propoxylated, fatty acid alkyl esters, preferably having 1 to 4 carbon atoms in the alkyl chain.

Nonionic surfactants of the amine oxide type, for example N-cocalkyl-N,N-dimethylamine oxide and N-tallowalkyl-N,N-dihydroxyethylamine oxide, and the fatty acid alkanolamides, can also be used. The quantity of these nonionic surfactants is preferably equal to no more than that of the ethoxylated fatty alcohols, in particular no more than half thereof.

Further suitable surfactants are polyhydroxy fatty acid amides of the formula

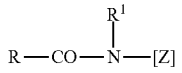

in which R denotes an aliphatic acyl residue having 6 to 22 carbon atoms; $R^1$ denotes hydrogen, an alkyl or hydroxyalkyl residue having 1 to 4 carbon atoms; and [Z] denotes a linear or branched polyhydroxyalkyl residue having 3 to 10 carbon atoms and 3 to 10 hydroxyl groups. Polyhydroxy fatty acid amides are known substances that can usually be obtained by reductive amination of a reducing sugar with ammonia, an alkylamine, or an alkanolamine, and subsequent acylation with a fatty acid, a fatty acid alkyl ester, or a fatty acid chloride. Also belonging to the group of the polyhydroxy fatty acid amides are compounds of the formula

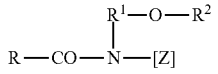

in which R denotes a linear or branched alkyl or alkenyl residue having 7 to 12 carbon atoms; $R^1$ denotes a linear, branched, or cyclic alkyl residue or an aryl residue having 2 to 8 carbon atoms; and $R^2$ denotes a linear, branched, or cyclic alkyl residue or an aryl residue or an oxyalkyl residue having 1 to 8 carbon atoms, $C_{1-4}$ alkyl or phenyl residues being preferred; and [Z] denotes a linear polyhydroxyalkyl residue whose alkyl chain is substituted with at least two hydroxyl groups, or alkoxylated, preferably ethoxylated or propoxylated, derivatives of that residue. [Z] is preferably obtained by reductive amination of a reduced sugar, for example glucose, fructose, maltose, lactose, galactose, mannose, or xylose. The N-alkoxy- or N-aryloxy-substituted compounds can be converted into the desired polyhydroxy fatty acid amides by reaction with fatty acid methyl esters in the presence of an alkoxide as catalyst.

Nonionic surfactants from the group of alkoxylated alcohols, particularly preferably from the group of mixed alkoxylated alcohols and in particular from the group of EO/AO/EO nonionic surfactants or PO/AO/PO nonionic surfactants, especially PO/EO/PO nonionic surfactants, are particularly preferred. These PO/EO/PO nonionic surfactants are notable for good foam control.

Anionic surfactants used are, for example, those of the sulfonate and sulfate types. Possibilities as surfactants of the sulfonate type are, for example, preferably $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having a terminal or internal double bond, by sulfonation with gaseous sulfur trioxide and subsequent alkaline or acid hydrolysis of the sulfonation products. Also suitable are alkanesulfonates that are obtained from $C_{12-18}$ alkanes, for example by sulfochlorination or sulfoxidation with subsequent hydrolysis or neutralization. Also suitable are the esters of $\alpha$-sulfo fatty acids (estersulfonates), for example the $\alpha$-sulfonated methyl esters of hydrogenated coconut, palm kernel, or tallow fatty acids.

Further suitable anionic surfactants are sulfonated fatty acid glycerol esters. "Fatty acid glycerol esters" are to be understood as the mono-, di- and triesters, and mixtures thereof, that are obtained in the context of manufacture by esterification of a monoglycerol with 1 to 3 mol fatty acid, or upon transesterification of triglycerides with 0.3 to 2 mol glycerol. Preferred sulfonated fatty acid glycerol esters are the sulfonation products of saturated fatty acids having 6 to 22 carbon atoms, for example hexanoic acid, octanoic acid, decanoic acid, myristic acid, lauric acid, palmitic acid, stearic acid, or behenic acid.

Preferred alk(en)yl sulfates are the alkali, and in particular sodium salts of the sulfuric acid semi-esters of $C_{12-18}$ fatty alcohols, for example from coconut fatty alcohol, tallow fatty alcohol, lauryl, myristyl, cetyl, or stearyl alcohol, or $C_{10}$ to $C_{20}$ oxo alcohols, and those semi-esters of secondary alcohols of those chain lengths. Also preferred are alk(en)yl sulfates of the aforesaid chain length that contain a synthetic straight-chain alkyl residue produced on a petrochemical basis, which possess a breakdown behavior analogous to those appropriate compounds based on fat-chemistry raw materials. For purposes of washing technology, the $C_{12}$ to $C_{16}$ alkyl sulfates and $C_{12}$ to $C_{15}$ alkyl sulfates, as well as $C_{14}$ to $C_{15}$ alkyl sulfates, are preferred. 2,3-Alkyl sulfates that can be obtained, for example, as commercial products of the Shell Oil Company under the name DAN®, are also suitable anionic surfactants.

Sulfuric acid monoesters of straight-chain or branched $C_{7-21}$ alcohols ethoxylated with 1 to 6 mol ethylene oxide, such as 2-methyl-branched $C_{9-11}$ alcohols with an average of 3.5 mol ethylene oxide (EO) or $C_{12-18}$ fatty alcohols with 1 to 4 EO, are also suitable. Because of their high-foaming behavior they are used in cleaning agents only in relatively small quantities, for example in quantities from 1 wt % to 5 wt %.

Other suitable anionic surfactants are also the salts of alkylsulfosuccinic acid, which are also referred to as sulfosuccinates or as sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol residues or mixtures thereof. Particularly preferred sulfosuccinates contain a fatty alcohol residue that derives from ethoxylated fatty alcohols that, considered per se, represent nonionic surfactants. Sulfosuccinates whose fatty alcohol residues derive from ethoxylated fatty alcohols having a restricted homolog distribution are, in turn, particularly preferred. It is likewise also possible to use alk(en)ylsuccinic acid having preferably 8 to 18 carbon atoms in the alk(en)yl chain, or salts thereof.

Soaps are particularly appropriate as further anionic surfactants. Saturated fatty acid soaps, such as salts of lauric acid, myristic acid, palmitic acid, stearic acid, hydrogenated erucic acid and behenic acid, are suitable, as are soap mixtures derived in particular from natural fatty acids, e.g. coconut, palm-kernel, or tallow fatty acids.

The anionic surfactants, including soaps, can be present in the form of their sodium, potassium, or ammonium salts and as soluble salts of organic bases such as mono-, di-, or triethanolamine. The anionic surfactants are preferably present in the form of their sodium or potassium salts, in particular in the form of sodium salts.

Instead of or in combination with the aforesaid surfactants, cationic and/or amphoteric surfactants can also be used.

Cationic active substances that can be used are, for example, cationic compounds of the following formulas:

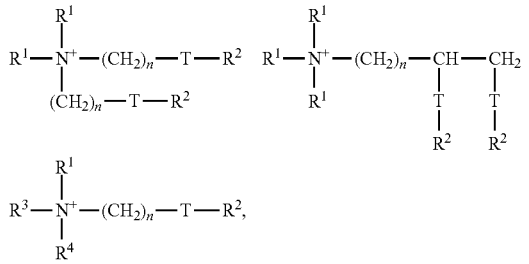

in which each group $R^1$ is selected mutually independently from $C_{1-6}$ alkyl, alkenyl, or hydroxyalkyl groups; each group $R^2$ is selected mutually independently from $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5.

Textile-softening compounds can be used for textile care and in order to improve textile properties, such as a softer "hand" (avivage) and decreased electrostatic charge (increased wearing comfort). The active agents in these formulations are quaternary ammonium compounds having two hydrophobic residues, for example distearyldimethylammonium chloride, although because of its insufficient biodegradability the latter is increasingly being replaced by quaternary ammonium compounds that contain ester groups in their hydrophobic residues as defined break points for biodegradation.

"Esterquats" of this kind having improved biodegradability are obtainable, for example, by esterifying mixtures of methyl diethanolamine and/or triethanolamine with fatty acids and then quaternizing the reaction products in known fashion with alkylating agents. Dimethylolethylene urea is additionally suitable as a finish.

Enzymes can be used to increase the performance of washing or cleaning agents. These include in particular proteases, amylases, lipases, hemicellulases, cellulases, perhydrolases, or oxidoreductases, as well as preferably mixtures thereof. These enzymes are in principle of natural origin; proceeding from the natural molecules, improved variants are available for use in washing or cleaning agents and are used in correspondingly preferred fashion. Washing or cleaning agents contain enzymes preferably in total quantities from $1\times10^{-6}$ to 5 wt %, based on active protein. The protein concentration can be determined with the aid of known methods, for example the BCA method or the biuret method.

Among the proteases, those of the subtilisin type are preferred. Examples thereof are subtilisins BPN' and Carlsberg and further developed forms thereof, protease PB92, subtilisins 147 and 309, the alkaline protease from *Bacillus lentus*, subtilisin DY, and the enzymes (to be classified, however, as subtilases and no longer as subtilisins in the strict sense) thermitase, proteinase K, and proteases TW3 and TW7.

Examples of usable amylases are the α-amylases from *Bacillus licheniformis*, from *B. amyloliquefaciens*, from *B. stearothermophilus*, from *Aspergillus niger* and *A. oryzae*, and the further developments of the aforementioned amylases improved for use in washing and cleaning agents. Additionally to be highlighted for this purpose are the α-amylase from *Bacillus* sp. A 7-7 (DSM 12368) and the cyclodextrin-glucanotransferase (CGTase) from *B. agaradherens* (DSM 9948).

Lipases or cutinases are usable because of their triglyceride-cleaving activity. Included thereamong are, for example, the lipases obtainable originally from *Humicola lanuginosa* (*Thermomyces lanuginosus*) or lipases further developed therefrom, in particular those having the D96L amino acid exchange. Also usable, for example, are the cutinases that were originally isolated from *Fusarium solani* pisi and *Humicola insolens*. Lipases and/or cutinases whose starting enzymes were originally isolated from *Pseudomonas mendocina* and *Fusarium solanii* are furthermore usable.

Enzymes that are grouped under the term "hemicellulases" can also be used. These include, for example, mannanases, xanthanlyases, pectinlyases (=pectinases), pectinesterases, pectatelyases, xyloglucanases (=xylanases), pullulanases, and β-glucanases.

Oxidoreductases, for example oxidases, oxygenases, catalases, peroxidases such as halo-, chloro-, bromo-, lignin, glucose, or manganese peroxidases, dioxygenases, or laccases (phenoloxidases, polyphenoloxidases), can be used if desired to intensify the bleaching effect. Advantageously, preferably organic, particularly preferably aromatic compounds that interact with the enzymes are additionally added in order to enhance the activity of the relevant oxidoreductases (enhancers) or, if there is a large difference in redox potential between the oxidizing enzymes and the stains, to ensure electron flow (mediators).

Enzymes can be used in any form established according to the existing art. This includes, for example, the solid preparations obtained by granulation, extrusion, or lyophilization or, in particular in the case of liquid or gelled agents, solutions of the enzymes, advantageously as concentrated as possible, low in water and/or with added stabilizers. Alternatively, the enzymes can be encapsulated for both the solid and the liquid administration form, for example by spray drying or extrusion of the enzyme solution together with a preferably natural polymer, or in the form of capsules, for example those in which the enzymes are enclosed e.g. in a solidified gel, or in those of the core-shell type, in which an enzyme-containing core is coated with a water-, air-, and/or chemical-impermeable protective layer. Further active agents, for example stabilizers, emulsifiers, pigments, bleaches, or dyes, can additionally be applied in superimposed layers. Such capsules are applied using methods known per se, for example by vibratory or roll granulation or in fluidized bed processes. Advantageously, such granulates are low in dust, for example as a result of the application of polymeric film-formers, and are shelf-stable because of the coating. It is furthermore possible to package two or more enzymes together, so that a single granulate exhibits multiple enzyme activities.

One or more enzymes and/or enzyme preparations, preferably protease preparations and/or amylase preparations, are preferably used, in quantities from 0.1 wt % to 5 wt %, preferably from 0.2 wt % to 4.5 wt %, and in particular from 0.4 wt % to 4 wt %.

Individual fragrance compounds, e.g. synthetic products of the ester, ether, aldehyde, ketone, alcohol, and hydrocarbon types, can be used as perfume oils or scents. It is preferred, however, to use mixtures of different fragrances that together generate an attractive scent note. Such perfume oils can also contain natural fragrance mixtures such as those accessible from plant sources, for example pine, citrus, jasmine, patchouli, rose, or ylang-ylang oil. In order to be perceptible, a fragrance must be volatile; in addition to the nature of the functional groups and the structure of the chemical compound, the molecular weight also plays an important part. Most fragrances, for example, possess molar weights of up to approximately 200 g/mol, while molar weights of 300 g/mol and above represent something of an exception. Because of the differing volatility of fragrances, the odor of a perfume or fragrance made up of multiple fragrances changes during volatilization, the odor impressions being subdivided into a "top note," "middle note" or "body," and "end note" or "dry out." Because the perception of an odor also depends a great deal on the odor intensity, the top note of a perfume or scent is not made up only of highly volatile compounds, while the end note comprises for the most part less-volatile, i.e. adherent fragrances. In the compounding of perfumes, more-volatile fragrances can, for example, be bound to specific fixatives, thereby preventing them from volatilizing too quickly. The division below of fragrances into "more-volatile" and "adherent" fragrances therefore makes no statement with regard to the odor impression, or as to whether the corresponding fragrance is perceived as a top or middle note. The scents can be processed directly, but it can also be advantageous to apply the scents onto carriers that ensure a slower scent release for a lasting scent. Cyclodextrins, for example, have proven successful as such carrier materials; the cyclodextrin-perfume complexes can additionally be coated with further adjuvants.

In selecting the coloring agent, care must be taken that the coloring agents exhibit excellent shelf stability and insensitivity to light, and they cannot have too strong an affinity with respect to textile surfaces and, particularly in this case, toward synthetic fibers. At the same time, it must also be considered that coloring agents have differing levels of stability with respect to oxidation. It is generally the case that water-insoluble coloring agents are more stable with respect to oxidation than water-soluble coloring agents. The concentration of the coloring agent in the washing or cleaning agents varies as a function of solubility and thus also of oxidation sensitivity. For readily water-soluble coloring agents, coloring-agent concentrations in the range of a few $10^{-2}$ wt % to $10^{-3}$ wt % are typically selected. In the case of pigment dyes, on the other hand, which are particularly preferred because of their brilliance but are less readily water-soluble, the appropriate concentration of the coloring agent in washing or cleaning agents is typically a few $10^{-3}$ wt % to $10^{-4}$ wt %. Coloring agents that can be oxidatively destroyed in a washing process, as well as mixtures thereof with suitable blue dyes, so-called bluing agents, are preferred. It has proven advantageous to use coloring agents that are soluble in water or at room temperature in liquid organic substances. Anionic coloring agents, e.g. anionic nitroso dyes, are suitable, for example.

In addition to the components recited hitherto, the washing or cleaning agents can contain further ingredients that further improve the applications-engineering and/or aesthetic properties of said agents. Preferred agents contain one or more substances from the group of electrolytes, pH adjusting agents, fluorescing agents, hydrotopes, foam inhibitors, silicone oils, anti-redeposition agents, optical brighteners, anti-gray agents, shrinkage preventers, crease prevention agents, color transfer inhibitors, antimicrobial active agents, germicides, fungicides, antioxidants, antistatic agents, ironing adjuvants, proofing and impregnation agents, swelling and anti-slip agents, and UV absorbers.

A large number of very varied salts from the group of the inorganic salts can be used as electrolytes. Preferred cations are the alkali and alkaline-earth metals; preferred anions are the halides and sulfates. From a production-engineering standpoint, the use of NaCl or $MgCl_2$ in the washing or cleaning agents is preferred.

In order to bring the pH of washing or cleaning agents into the desired range, the use of pH adjusting agents may be indicated. All known acids or bases are usable here, provided their use is not prohibited for environmental or applications-engineering reasons, or for reasons of consumer safety. The quantity of these adjusting agents usually does not exceed 1 wt % of the total formulation.

Appropriate foam inhibitors are soaps, oils, fats, paraffins, or silicone oils, which optionally can be applied onto carrier materials. Suitable carrier materials are, for example, inorganic salts such as carbonates or sulfates, cellulose derivatives, or silicates, as well as mixtures of the aforesaid materials. Agents preferred in the context of the present application contain paraffins, preferably unbranched paraffins (n-paraffins), and/or silicones, preferably linear-polymer silicones, which are constructed according to the $(R_2SiO)_x$ pattern and are also referred to as silicone oils. These silicone oils usually represent clear, colorless, neutral, odorless, hydrophobic liquids having a molecular weight between 1000 g/mol and 150,000 g/mol and viscosities between 10 mPa·s and 1,000,000 mPa·s.

Suitable anti-redeposition agents are, for example, nonionic cellulose ethers such as methyl cellulose and methylhydroxypropyl cellulose having a 15 to 30 wt % proportion of methoxy groups and a 1 to 15 wt % proportion of hydroxypropyl groups, based in each case on the nonionic cellulose ether.

Suitable soil repellents are polymers, known from the existing art, of phthalic acid and/or terephthalic acid or derivatives thereof, in particular polymers of ethylene terephthalate and/or polyethylene glycol terephthalate or anionically and/or nonionically modified derivatives thereof. Of these, the sulfonated derivatives of phthalic acid polymers and terephthalic acid polymers are particularly preferred.

Optical brighteners can be added in particular to washing agents in order to eliminate graying and yellowing of the treated textiles. These substances absorb onto the fibers and cause brightening and a simulated bleaching effect by converting invisible ultraviolet radiation into longer-wave visible light, the ultraviolet light absorbed from sunlight being emitted as slightly bluish fluorescence and resulting, with the yellow tone of the grayed or yellowed laundry, in pure white. Suitable compounds derive, for example, from the substance classes of 4,4'-diamino-2,2'-stilbenedisulfonic acids (flavonic acids), 4,4'-distyrylbiphenyls, methylumbelliferones, cumarins, dihydroquinolinones, 1,3-diarylpyrazolines, naphthalic acid imides, benzoxazole, benzisoxazole, and benzimidazole systems, and pyrene derivatives substituted with heterocycles.

The purpose of anti-gray agents is to keep dirt that has been detached from fibers suspended in the bath, and thus to prevent redeposition of the dirt. Water-soluble colloids, usually organic in nature, are suitable for this, for example water-soluble salts of polymeric carboxylic acids, size, gelatin, salts of ethersulfonic acids of starch or of cellulose, or salts of acidic sulfuric-acid esters of cellulose or of starch. Water-soluble polyamides containing acid groups are also suitable for this purpose. Soluble starch preparations can furthermore be used, for example degraded starch, aldehyde starches, etc. Polyvinylpyrrolidone is also usable. Cellulose ethers such as carboxymethyl cellulose (sodium salt), methyl cellulose, hydroxyalkyl cellulose, and mixed ethers such as methylhydroxyethyl cellulose, methylhydroxypropyl cellulose, methylcarboxymethyl cellulose, and mixtures thereof, are also usable as anti-gray agents.

Because textile fabrics, in particular those made of rayon, viscose, cotton, and mixtures thereof, can tend to wrinkle because the individual fibers are sensitive to bending, kinking, compression, and squeezing perpendicularly to the fiber direction, synthetic crease-prevention agents can be used. These include, for example, synthetic products based on fatty acids, fatty acid esters, fatty acid amides, fatty acid alkylol esters, fatty acid alkylolamides, or fatty alcohols that are usually reacted with ethylene oxide, or products based on lecithin or modified phosphoric acid esters.

The purpose of proofing and impregnation methods is to finish textiles with substances that prevent the deposition of dirt or make it easier to wash out. Preferred proofing and impregnation agents are perfluorinated fatty acids, including in the form of their aluminum and zirconium salts, organic silicates, silicones, polyacrylic acid esters having perfluorinated alcohol components, or polymerizable compounds coupled to a perfluorinated acyl or sulfonyl residue. Antistatic agents can also be contained. Dirt-repellent finishing with proofing and impregnation agents is often categorized as an "easy-care" finish. Penetration of the impregnation agents, in the form of solutions or emulsions of the relevant active agents, can be facilitated by the addition of wetting agents that reduce surface tension. A further area of use of proofing and impregnation agents is water-repellent finishing of textile materials, tents, awnings, leather, etc. in which, in contrast to waterproofing, the fabric pores are not sealed, i.e. the material is still able to "breathe" (hydrophobizing). The hydrophobizing agents used for hydrophobizing cover the textiles, leather, paper, wood, etc. with a very thin layer of hydrophobic groups such as longer alkyl chains or siloxane groups. Suitable hydrophobizing agents are, for example, paraffins, waxes, metal soaps, etc. having added portions of aluminum or zirconium salts, quaternary ammonium compounds with long-chain alkyl residues, urea derivatives, fatty acid-modified melamine resins, chromium-complex salts, silicones, organo-tin compounds, and glutaric dialdehyde, as well as perfluorinated compounds. The hydrophobized materials are not oily to the touch, but water droplets bead up on them (similarly to oiled fabrics) without wetting them. Silicone-impregnated textiles, for example, have a soft hand and are water- and dirt-repellent; drops of ink, wine, fruit juice, and the like are easier to remove.

Antimicrobial active substances can be used in order to counteract microorganisms. A distinction is made here, in terms of the antimicrobial spectrum and mechanism of action, between bacteriostatics and bactericides, fungistatics and fungicides, etc. Substances from these groups are, for example, benzalkonium chlorides, alkylarylsulfonates, halogen phenols, and phenol mercuric acetate; these compounds can also be entirely omitted.

The agents can contain antioxidants in order to prevent undesirable changes to the washing and cleaning agents and/or to the treated textiles caused by the action of oxygen and other oxidative processes. This class of compounds includes, for example, substituted phenols, hydroquinones, catechols, and aromatic amines, as well as organic sulfides, polysulfides, dithiocarbamates, phosphites, and phosphonates.

Increased wearing comfort can result from the additional use of antistatic agents. Antistatic agents increase the surface conductivity and thus make possible improved dissipation of charges that have formed. External antistatic agents are usually substances having at least one hydrophilic molecule ligand, and yield a more or less hygroscopic film on the surfaces. These usually surface-active antistatic agents can be subdivided into nitrogen-containing (amines, amides, quaternary ammonium compounds), phosphorus-containing (phosphoric acid esters), and sulfur-containing antistatic agents (alkylsulfonates, alkyl sulfates). Lauryl- (or stearyl) dimethylbenzylammonium chlorides are likewise suitable as antistatic agents for textile fabrics or as an additive to washing agents, an avivage effect additionally being achieved.

Silicone derivatives can be used in textile washing agents in order to improve the water absorption capability and rewettability of the treated textile fabrics and to facilitate ironing of the treated textiles. These additionally improve the rinsing behavior of washing or cleaning agents thanks to their foam-inhibiting properties. Preferred silicone derivatives are, for example, polydialkyl- or alkylarylsiloxanes in which the alkyl groups comprise one to five carbon atoms and are entirely or partly fluorinated. Preferred silicones are polydimethylsiloxanes, which optionally can be derivatized and are then aminofunctional or quaternized or comprise Si—OH, Si—H, and/or Si—Cl bonds. Further preferred silicones are the polyalkylene oxide-modified polysiloxanes, i.e. polysiloxanes that comprise, for example, polyethylene glycols, as well as polyalkylene oxide-modified dimethylpolysiloxanes.

Lastly, UV absorbers, which are absorbed onto the treated textiles and improve the light-fastness of the fibers, can also be used. Compounds that exhibit these desired properties are, for example, the compounds that act by radiationless deactivation, and derivatives of benzophenone having substituents in the 2- and/or 4-position. Also suitable are substituted benzotriazoles, acrylates phenyl-substituted in the 3-position (cinnamic acid derivatives) optionally having cyano groups in the 2-position, salicylates, organic nickel complexes, and natural substances such as umbelliferone and endogenous urocanic acid.

Protein hydrolysates are further suitable active substances because of their fiber-care-providing effect. Protein hydrolysates are product mixtures that are obtained by acid-, base-, or enzyme-catalyzed breakdown of proteins. Protein hydrolysates of both vegetable and animal origin can be used. Animal protein hydrolysates are, for example, elastin, collagen, keratin, silk, and milk protein hydrolysates, which can also be present in the form of salts. It is preferred to use protein hydrolysates of vegetable origin, e.g. soy, almond, rice, pea, potato, and wheat protein hydrolysates. Although the use of protein hydrolysates as such is preferred, amino acid mixtures obtained in other ways, or individual amino acids such as arginine, lysine, histidine, or pyroglutamic acid, can also optionally be used instead of them. It is also possible to employ derivatives of protein hydrolysates, for example in the form of their fatty acid condensation products.

EXAMPLES

Example 1

Manufacture of Tetraethylene Glycol Digallate 27.5 mmol 3,4,5-trimethoxybenzoyl chloride dissolved in pyridine was dripped into 25 mmol tetraethylene glycol in pyridine while stirring, under a nitrogen atmosphere with ice cooling. The reaction solution was heated to boiling under reflux. After subsequent cooling, filtration was performed, the filtrate had ice added to it, was acidified with HCl, and extracted with dichloromethane. The intermediate product, reduced in volume under vacuum, was dripped into anhydrous aluminum chloride (1.8 equivalents per methoxy group) made up in 140 ml $CH_2Cl_2$ with ethanethiol added with ice cooling. Water was then added, and the reaction mixture was acidified with HCl. The aqueous phase was separated, and extracted with ethyl acetate.

Example 2

Cleaning Performance

Washing tests were carried out at 40° C. as three determinations on standardized stains (indicated in Table 1) on cotton, using a bleaching-agent-free liquid washing agent (containing 7.5 wt % sevenfold-ethoxylated $C_{12/14}$ fatty alcohol, 7.5 wt % sodium $C_{9-13}$ alkylbenzenesulfonate, 1 wt % citric acid, 3 wt % $C_{12-18}$ fatty acid, 0.1 wt % diethylenetriaminepenta(methylenephosphonic acid) heptasodium salt, 0.6 wt % NaOH, remainder to 100 wt % water) having a pH of 8.5, and preparing therewith a washing bath W1 made up of 79 g liquid washing agent and 1.6 g tetraethylene glycol digallate in 17 l water of 16° dH. For comparison, an otherwise identical washing bath V1 was made up containing only the liquid washing agent, and a washing bath V2 otherwise identical to W1 that contained, instead of tetraethylene glycol digallate, the same quantity of gallic acid ester of tetraethylene glycol monomethyl ether. The evaluation was performed by measuring color difference in accordance with L*a*b values, and the Y values calculated therefrom as an indication of brightness. The table below shows the dY values that were obtained from the difference between Y(after washing) and Y(before washing).

TABLE 1

| | dY values | | |
|---|---|---|---|
| Stain | W1 | V1 | V2 |
| Cherry | 37.6 | 24.9 | 28.7 |
| Bilberries | 34.8 | 31.4 | 33.5 |

The dY values in the context of use of the substance essential to the invention were significantly higher than those resulting from the use only of the liquid washing agent or of the comparison substance, corresponding to greater whiteness and thus improved stain removal.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A textile washing or cleaning agent comprising compounds of the general formula (I), (I)

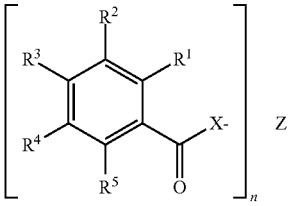

in which $R^1$, $R^2$, $R^3$, $R^4$, and $R^5$ mutually independently denote hydrogen or OH with the provision that at least three of said residues are OH, X denotes oxygen or NR, n is a number from 2 to 20, and Z denotes a cyclic or acyclic, straight-chain or branched-chain, n-bonded hydrocarbon residue having 2 to 100 carbon atoms, whose skeleton can be penetrated by one or more non-adjacent oxygen or nitrogen atoms and/or can be mono- or polysubstituted with hydrophilic groups such as NRR', COOR, CONRR', and/or OR, R and R' mutually independently denote hydrogen or a cyclic or acyclic, straight-chain or branched-chain, aliphatic or aromatic hydrocarbon residue having 1 to 20 carbon atoms, and wherein the textile washing or cleaning agent further comprises a builder selected from the group of builders consisting of zeolites, silicates, carbonates, and organic cobuilders.

2. The washing or cleaning agent according to claim 1, wherein the compound of the general formula (I) is an ester of a polyalkylene glycol or an amide of a polyalkyleneimine, the oxygen or nitrogen atoms of which are separated from one another by alkylene groups having 2 to 12 carbon atoms.

3. The washing or cleaning agent according to claim 2, wherein the alkylene groups are selected from ethylene groups, 1,2-propylene groups, 1,3-propylene groups, and mixtures thereof.

4. The washing or cleaning agent according to claim 1, wherein it contains no hypochlorites, hydrogen peroxide, or substances yielding hydrogen peroxide.

* * * * *